United States Patent [19]

Munthe

[11] Patent Number: 4,759,475

[45] Date of Patent: Jul. 26, 1988

[54] FILLING APPARATUS FOR DISPENSING LIQUIDS AND PREVENTING SPILLAGE THEREOF

[75] Inventor: Bert A. Munthe, Hugo, Minn.

[73] Assignee: Minnesota Mining and Manufacturing Co., St. Paul, Minn.

[21] Appl. No.: 2,858

[22] Filed: Jan. 13, 1987

[51] Int. Cl.[4] ..... B67D 5/60

[52] U.S. Cl. ..... 222/464; 222/518; 251/354

[58] Field of Search ..... 222/382, 211, 464, 509, 222/518, 537, 377; 251/354, 144; 141/55, 66

[56] References Cited

U.S. PATENT DOCUMENTS

| | | | |
|---|---|---|---|
| 687,253 | 11/1901 | Morgan | 141/369 |
| 1,266,195 | 5/1918 | Beckmann | 222/518 |
| 2,174,354 | 9/1939 | Shields | 222/464 |
| 2,562,111 | 7/1951 | Michel | 222/518 |
| 2,723,055 | 11/1955 | Beard, Jr. | 222/518 |
| 2,743,078 | 4/1956 | Jordan | 222/464 |
| 2,751,123 | 6/1956 | Kuhles et al. | 222/464 |
| 3,115,907 | 12/1963 | Labat | 141/295 |
| 3,163,188 | 12/1964 | Morris | 141/369 |
| 3,181,576 | 5/1965 | Pellerino et al. | 141/293 |
| 3,278,094 | 10/1966 | Perry | 222/479 |
| 3,501,067 | 3/1970 | Riger | 222/464 |
| 3,631,904 | 1/1972 | Mason et al. | 141/351 |

FOREIGN PATENT DOCUMENTS

| | | |
|---|---|---|
| 159680 | 2/1903 | Fed. Rep. of Germany . |
| 866314 | 2/1953 | Fed. Rep. of Germany . |
| 1082229 | 9/1967 | United Kingdom . |

OTHER PUBLICATIONS

KATS SH A 09.08.76-SU-399720.

*Primary Examiner*—Joseph J. Rolla
*Assistant Examiner*—Kenneth Noland
*Attorney, Agent, or Firm*—Donald M. Sell; David L. Weinstein

[57] ABSTRACT

System for storing and transferring liquid comprising a container for storing liquids, a delivery tube assembly for drawing liquids from said container and transferring said liquids to a second vessel, and, disposed at one end of the delivery tube assembly, a shut-off valve that comprises a casing having a first opening at one end thereof for allowing liquid to enter said casing, a valve head which is normally covering said opening, and a device for biasing said valve head toward said first opening in order to cover same. The container has an actuating device, e.g. a projection, formed on or near the bottom portion thereof, which device actuates the valve head to allow the shut-off valve to open, thereby allowing liquid to be drawn into the first opening in the casing, pass through the casing, and then pass through a second opening in the casing to enter the delivery tube assembly. When the delivery tube assembly and shut-off valve are removed from the container, the valve head closes over said first opening, thereby preventing residual liquid present in the delivery tube assembly from leaking from the tube.

8 Claims, 1 Drawing Sheet

FILLING APPARATUS FOR DISPENSING LIQUIDS AND PREVENTING SPILLAGE THEREOF

FIELD OF THE INVENTION

This invention relates to improvements in valve-controlled apparatus used to deliver liquids from bottles, cans, and other containers.

DESCRIPTION OF THE PRIOR ART

U.S. Ser. No. 884,974, filed July 14, 1986, describes a mixing system adapted for use in mixing with a solvent or carrier fluid, such as water, concentrates of chemicals which are used in performing certain janitorial services. Such concentrates may include detergents, ammonia, disinfectants, degreasers, and deodorizers such that solutions may be mixed up by the janitorial staff to carry out the tasks prescribed.

According to the system described in that application, the concentrates are delivered from large containers to the mixing vessel by means of tubes which are connected to both the containers of concentrate and the mixing vessel. When a container of concentrate is emptied, the empty container is replaced with a full container which contains the same concentrate that was consumed. In order to replace an empty container, the tube is detached from the container, the container is disposed of, and a full container is reattached to the tube. During the interval of time that the container is being replaced, it frequently happens that residual concentrate in the tube leaks onto the floor where the concentrate-containing containers are located. Some of these concentrates are toxic, corrosive, or flammable, and it would be desirable to keep them from finding their way to the floor. Moreover, air can enter the tubes, which further requires that pumps used for drawing concentrates from the containers into the tubes must be re-primed.

In view of the foregoing problems, it would be desirable to provide a means for sealing the tubes during the interval when the empty containers are replaced with full ones.

SUMMARY OF THE INVENTION

This invention provides, in combination, a system for supplying liquid to a vessel comprising (1) a container for storing and dispensing liquids and (2) a delivery tube assembly including a shut-off valve disposed at one end thereof. The container is a receptable having a wall, which has a bottom portion, and an opening in the wall for passage of liquid out of the container. The delivery tube assembly can be inserted into the container through the opening in the wall thereof and can be removed from the container via the same opening. The delivery tube assembly has both an intake end and a discharge end, the intake end being located within the container and the discharge end being located outside the container during the time the liquid is delivered to the vessel. The shut-off valve is disposed at the intake end of the delivery tube assembly. During the delivery operation, the shut-off valve is actuated by an actuating means disposed on the wall of the container that is at or in close proximity to the bottom portion of the container. Upon actuation, the shut-off valve will open to allow liquid in the container to enter the intake end of the delivery tube assembly, which liquid will travel the length of the delivery tube assembly, and exit from the discharge end of the delivery tube assembly. When the delivery tube assembly is removed from the container, the shut-off valve is no longer actuated, thereby preventing residual liquid present in the delivery tube assembly from leaking therefrom.

In the preferred embodiment, the shut-off valve comprises a casing having a first opening therein to allow passage of liquid from the container into the casing, a second opening therein to allow passage of liquid from the casing into the intake end of the delivery tube assembly, a valve head that covers said first opening in the casing when the shut-off valve is not actuated, and means for biasing said valve head against said casing to close said first opening in said casing when said valve head is not being actuated. It is preferred that the wall of the container have means for aligning the shut-off valve with the actuating means so that the actuating means can readily actuate the valve head.

The shut-off valve prevents liquids from leaking out of the delivery tube assembly when the shut-off valve is not being actuated by the actuating means and allows liquids to enter the intake end of the delivery tube assembly only when the shut-off valve is actuated by the actuating means.

DETAILED DESCRIPTION

Figure 1:
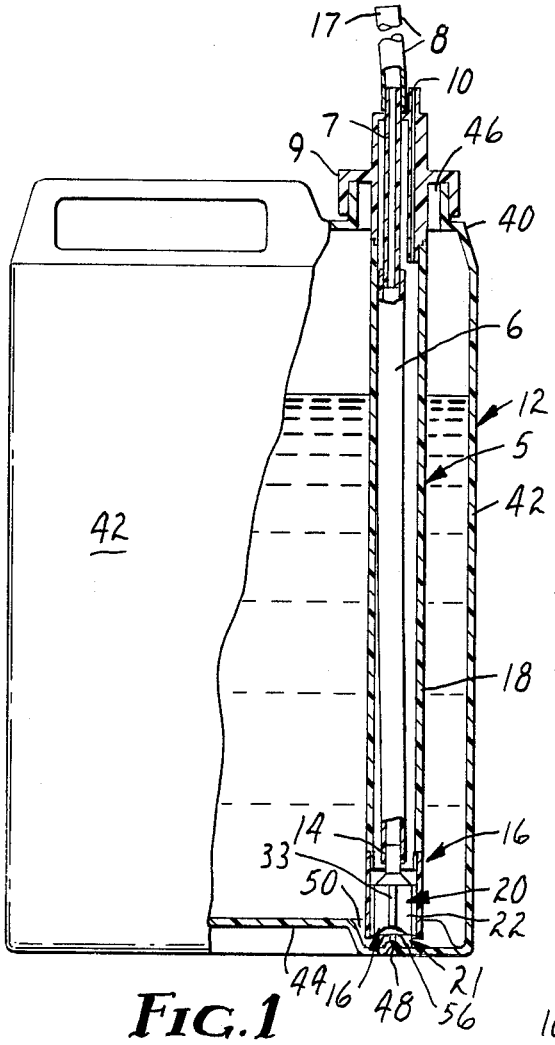
FIG. 1 is a cross-sectional view in elevation of a container, delivery tube assembly, and shut-off valve of the liquid storage and transfer system of the present invention.
Figure 4:
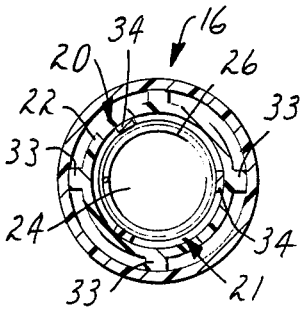
FIG. 4 is a cross-sectional view taken along line 4—4 of FIG. 3.
Figure 2:
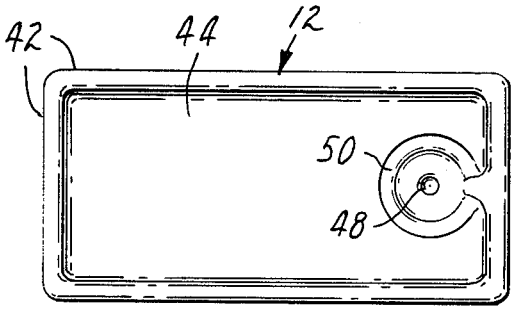
FIG. 2 is a plan view of the base of the preferred embodiment of the container of the system of the present invention.
Figure 3:
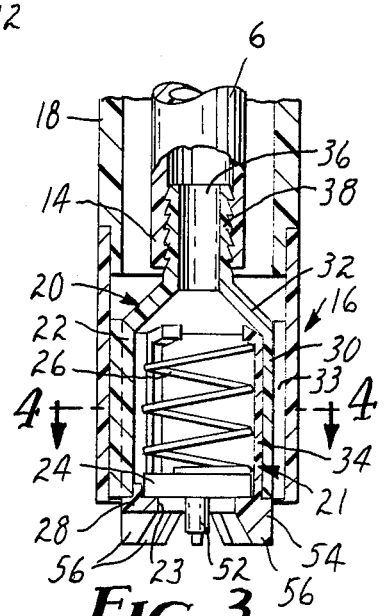
FIG. 3 is an enlarged cross-sectional view in elevation of the shut-off valve of the system of the present invention.

Referring now to FIGS. 1, 2, 3, and 4, where like numerals refer to like parts, the delivery tube assembly 5 comprises a tube or series of tubes, the function of which is to transfer liquid from a container to a second vessel. In the embodiment shown in FIG. 1, which is representative of a delivery tube assembly that comprises a series of tubes rather than a single tube, delivery tube assembly 5 comprises an intake tube 6, a connecting tube 7, and a discharge tube 8. Connecting tube 7 joins intake tube 6 to discharge tube 8. Delivery tube assembly 5 also includes a cap 9 having a vent 10 formed therein. Cap 9 is preferably a threaded cap that can be screwed onto a threaded container opening. Intake tube 6, connecting tube 7, and discharge tube 8 are typically cylindrical tubes of sufficient diameter and length to allow liquids to be drawn from the container 12 and be transferred to another vessel, e.g. a mixing vessel (not shown). However, the shape of the tubes in the delivery tube assembly is not critical, and they can have cross-sectional shapes other than cylindrical. Disposed at one end 14, i.e. the intake end, of intake tube 6 of delivery tube assembly 5 is shut-off valve 16. Delivery tube assembly 5 and its accompanying shut-off valve 16 can be removed from container 12 to facilitate replacement of one container for another. Delivery tube assembly 5 also has a discharge end 17 at one end of discharge tube 8, from which end the liquid can exit so that it can enter another vessel (not shown). During operation of the system, intake end 14 must be within container 12 and discharge end 17 must be outside container 12. Delivery tube assembly 5 is preferably sheathed by an outer tube 18, the function of which, in combination with a sensor system (not shown), is to determine when the liquid in container 12 has dropped to a low level and indicate same. When the liquid inside container 12 falls to a nearly empty level, the pressure in the space between delivery tube assembly 5 and tube 18 will likewise decrease. Fluid level sensors capable of measuring such pressure differentials to indicate that the container is nearly empty are well-known in the art. Tube 18 also preferably functions to provide additional support for shut-off valve 16.

Shut-off valve 16 comprises a casing 20, which, for ease of manufacture, is preferably made of two parts, an inner portion 21 and an outer portion 22. Inner portion 21 fits within outer portion 22. Casing 20 has a first opening 23 therein. Located within casing 20 are a valve head 24, which normally covers first opening 23 to prevent residual liquid in delivery tube assembly 5 from flowing through first opening 23, and means 26 for biasing valve head 24 against casing 20 to close first opening 23 in casing 20. Casing 20 should be of sufficient length and cross-sectional area to contain valve head 24 and spring 26. Valve head 24 must be of a size sufficiently large to completely cover and seal first opening 23 when valve head 24 is not actuated and sufficiently small to be capable of moving freely within casing 20 to allow shut-off valve 16 to be actuated. As used herein, the terms "actuate", "actuated", and the like refer to both (1) moving valve head 24 away from first opening 23 in casing 20 and (2) causing shut-off valve 16 to open by moving of valve head 24. The shape of valve head 24 is preferably similar to that of the cross-section of casing 20. Preferably, valve head 24 is a disk-shaped plug, and biasing means 26 is a spring, preferably made of a metal such as stainless steel. Other biasing means include resilient polymeric materials, e.g. polymeric foams. As used hereinafter, the term "spring" shall be used to denote the biasing means.

In the preferred embodiment of this invention, casing 20 is essentially cylindrical in shape, and it comprises a circular base 28, a cylindrical wall portion 30, and a circular top 32. Base 28 is also the base of inner portion 21 of casing 20. Wall portion 30 and top 32 are also the wall and the top of outer portion 22, respectively, of casing 20. It is preferred that wall portion 30 have a plurality of spacing elements 33 molded or adhered to the outer periphery thereof, the function of which elements 33 is to allow space between casing 20 and outer tube 18, so that the sensor system previously referred to can operate satisfactorily. First opening 23 is formed in base 28. Inset at the periphery or at a small distance from the periphery of base 28 and projecting upwardly therefrom are a plurality of ribs 34, preferably three in number. The functions of the ribs 34 are to form a channel or guide for valve head 24 to move when it is actuated and to support the spring 26. There must be sufficient space between adjacent ribs 34 so that the liquid that enters first opening 23 will have a channel to flow from opening 23 through the interior of casing 20 and into the intake end 14 of intake tube 6 of delivery tube assembly 5. Located in top 32 of casing 20 is a second opening 36 that communicates with intake end 14 of intake tube 6, typically by way of a nipple 38 that fits into end 14 of intake tube 6.

Container 12 typically has a top 40, side walls 42, and a base or bottom portion 44. It may have a cross-section of any shape, e.g. polygonal, cylindrical. Additionally, container 12 may be spherical in shape, such as, for example, in the form of a round-bottomed flask. An opening 46 is formed in container 12, normally in top 40 or side walls 42 thereof, to allow insertion of intake end 14 of delivery tube assembly 5 into container 12. Container 12 must have an actuating means, typically a projection or protuberance 48, in order to actuate valve head 24 of shut-off valve 16 to cause valve head 24 to move so as to allow shut-off valve 16 to open and to allow liquid to enter first opening 23 of casing 20. Actuating means 48 is preferably located at or near the bottom portion of container 12, i.e. on base 44 or on side walls 42 adjacent base or bottom portion 44. The walls of container 12 adjacent actuating means 48 preferably contains alignment means to allow delivery tube assembly 5 to be fitted in container 12 so that actuating means 48 will be aligned with valve head 24 of shut-off valve 16. Alignment means is preferably in the form of an annulus 50 which defines a tapered recess surrounding the actuating means 48 at or near the bottom portion 44 of container 12.

Actuating means 48 is preferably a projection of sufficient height or length that valve head 24 will move upwardly a sufficient distance when pressed against it so that liquid can enter first opening 23, pass through casing 20, and enter intake end 14 of intake tube 6 of delivery tube assembly 5.

In the embodiment shown in FIGS. 1–4, valve head 24 has a stem 52 attached thereto and projecting downwardly therefrom through first opening 23 so as to be disposed between valve head 24 and actuating means 48 on base 44 of container 12. Container 12 can be designed so as to have actuating means 48 located on a portion of its wall other than on base 44 thereof. This stem 52 is designed so as to contact actuating means 48 in order to cause valve head 24 to move in such a direction as to allow shut-off valve 16 to open to allow liquid to enter first opening 23. However, shut-off valve 16 and container 12 can be designed so as to eliminate the need for stem 52. If stem 52 is present, it must not extend beyond end 54 of shut-off valve 16 whereat first opening 23 is located. If stem 52 were to extend beyond end 54 of shut-off valve 16, accidental contact of stem 52 with the floor or any other surface would cause valve head 24 to move so as to cause shut-off valve 16 to open, allowing the liquid to leak out of delivery tube assembly 5. In the embodiment shown in FIG. 3, end 54 of shut-off valve 16 facing base 44 of container 12 further includes a plurality of projections 56 extending therefrom. Although these projections are optional, they can be designed to perform the dual function of (a) coarsely aligning shut-off valve 16 with actuating means 48, and (b) finely aligning valve stem 52 (if present) with actuating means 48. These projections are constructed so as to fit into alignment means 50. It is preferred that the shape of projections 56 be such that they urge stem 52 to align at or near the center of projection 48 to insure that shut-off valve 16 will be actuated when projections 56 are aligned by alignment means 50. If stem 52 were to strike projection 48 at a position off of its center, shut-off valve 16 may not open sufficiently to allow liquid from container 12 to be transferred satisfactorily. Adjacent projections 56 must have sufficient space between them so that liquid can pass from container 12 into first opening 23. In the embodiment shown in FIG. 3, stem 52 must not extend beyond the tips of projections 56 farthest from end 54 of shut-off valve 16. Container 12, delivery tube assembly 5, and the components of shut-off valve 16 are preferably prepared from materials that are resistant to the chemicals that make up the liquids that are to be delivered from the container. Preferred materials for the container, delivery tube assembly, and components of the shut-off valve, excepting spring 26, include polymeric materials, e.g. polyethylene, polypropylene. Preferred materials for spring 26 include stainless steel. When outer tube 18 is used, it is preferred that either outer tube 18 or delivery tube assembly 5 should be formed of a relatively rigid material so that fitting of shut-off valve 16 into alignment means 50 will be facilitated. If delivery tube assembly 5 is used alone, it is preferred that it be formed of a relatively rigid material.

Although shapes and dimensions of the component parts of the shut-off valve can vary, a preferred embodiment can have the following dimensions:

| | |
|---|---|
| Casing: | 2.5 inches length; 1.25 inches outside diameter |
| First opening in casing: | 0.500 inch diameter |
| Valve stem: | 0.156 inch length; 0.190 inch diameter |
| Biasing means: | 0.041 inch wire diameter of spring; 5 coils per inch; 0.750 inch length; 0.687 inch diameter |
| Valve head: | 0.684 inch diameter; 0.31 inch thickness |
| Actuating means: | 0.44 inch length |

OPERATION

To connect a container 12 of the type previously described, and filled with a liquid concentrate, to a delivery tube assembly 5 fitted with shut-off valve 16 of this invention, the user merely aligns shut-off valve 16 with alignment means 50 so that actuating means 48 will be aligned with first opening 23 in casing 20. Shut-off valve 16 is then urged downwardly toward base 44 of container 12, thereby allowing actuating means 48 to cause valve head 24 to move so as to allow fluid to enter casing 20 through first opening 23, from which casing, the liquid is delivered through second opening 36 to intake tube 6, from which tube, via connecting tube 7 and discharge tube 8, the liquid is delivered to another vessel.

When it comes time to replace container 12, shut-off valve 16 is merely urged away from base 44 of container 12, thereby allowing spring 26 to cause valve head 24 to move so as to close first opening 23 to prevent liquid from leaking from delivery tube assembly 5.

Various modifications and alterations of this invention will become apparent to those skilled in the art without departing from the scope and spirit of this invention, and it should be understood that this invention is not to be unduly limited to the illustrative embodiments set forth herein.

What is claimed is:

1. A liquid storage and transfer system, said system comprising:
   (a) a container having a wall with a bottom portion and an opening in said wall for the passage of liquid out, of said container;
   (b) a delivery tube assembly fitted within said opening, said delivery tube assembly being removable from said opening to facilitate changing containers and being repositionable within said opening, said delivery tube assembly having a discharge end and an intake end, said discharge end being outside said container and said intake end being inside said container; and
   (c) a shut-off valve disposed at said intake end of said delivery tube assembly, said shut-off valve being at or adjacent said bottom portion of said container, said shut-off valve being normally closed to the passage of liquid when said shut-off valve is not actuated; and
   (d) actuating means within said container disposed on said container wall for actuating said shut-off valve to permit the passage of liquid into said delivery tube when said delivery tube assembly is repositioned within said opening and the shut-off valve is brought into contact with the actuating means.

2. The system of claim 1 wherein said shut-off valve comprises a casing having a first opening therein, a valve head that covers and closes said first opening when said valve head is not actuated, and a means for biasing said valve head against said casing to close said first opening when said valve head is not actuated.

3. The system of claim 2 wherein said casing comprises a cylindrical body having a circular base, side walls, and a circular top, said first opening in said casing being in said circular base, said casing having a second opening in said circular top that communicates with said delivery tube, said casing further including a plurality of ribs disposed at or closely inset from the periphery of said circular base and projecting upwardly from said circular base, said ribs providing a guide for said valve head and a support for said biasing means, said ribs further being spaced sufficiently apart so that liquid can flow through said casing when said shut-off valve is actuated.

4. The system of claim 2 wherein said valve head includes a valve stem which contacts said actuating means to urge said shut-off valve open.

5. The system of claim 2 wherein said actuating means comprises a projection which contacts said valve head to urge said shut-off valve open.

6. The system of claim 4 wherein said actuating means comprises a projection which contacts said valve stem to urge said shut-off valve open.

7. The system of claim 1 further including means for aligning said shut-off valve with said actuating means.

8. The system of claim 1 wherein said actuating means is located at the bottom portion of a wall of said container.

* * * * *

UNITED STATES PATENT AND TRADEMARK OFFICE

CERTIFICATE OF CORRECTION

PATENT NO. : 4,759,475

DATED : July 26, 1988

INVENTOR(S) : Bert A. Munthe

It is certified that error appears in the above-identified patent and that said Letters Patent is hereby corrected as shown below:

Col. 6, line 6, delete comma after "out".

Signed and Sealed this

Sixth Day of June, 1989

*Attest:*

*Attesting Officer*

DONALD J. QUIGG

*Commissioner of Patents and Trademarks*